US006061634A

United States Patent [19]

Belani et al.

[11] Patent Number: 6,061,634

[45] Date of Patent: May 9, 2000

[54] METHOD AND APPARATUS FOR CHARACTERIZING EARTH FORMATION PROPERTIES THROUGH JOINT PRESSURE-RESISTIVITY INVERSION

[75] Inventors: Ashok Belani, St. Cloud, France; Terizhandur S. Ramakrishnan, Bethel; Tarek M. Habashy, Danbury, both of Conn.; Fikri John Kuchuk, Dubai, United Arab Emirates; Luis Ayestaran, Buenos Aires, Argentina

[73] Assignee: Schlumberger Technology Corporation, Ridgefield, Conn.

[21] Appl. No.: 08/843,206

[22] Filed: Apr. 14, 1997

[51] Int. Cl.[7] ..... G06F 19/00

[52] U.S. Cl. ..... 702/12

[58] Field of Search ..... 702/12, 13; 73/152.31, 73/152.41, 152.52

[56] References Cited

U.S. PATENT DOCUMENTS

| | | | |
|---|---|---|---|
| 2,747,401 | 5/1956 | Doll | 73/151 |
| 4,495,805 | 1/1985 | Dowling et al. | 73/155 |
| 4,742,459 | 5/1988 | Lasseter | 364/422 |
| 4,860,581 | 8/1989 | Zinnerman | 73/155 |
| 5,247,830 | 9/1993 | Goode | 73/155 |
| 5,269,180 | 12/1993 | Dave | 73/152 |
| 5,335,542 | 8/1994 | Ramakrishnan | 73/152 |
| 5,497,321 | 3/1996 | Ramakrishnan | 364/422 |

OTHER PUBLICATIONS

"Formation Imaging with Microelectrical Scanning Arrays" by Ekstrom et al., The Log Analyst, May–Jun. 1987: pp. 294–306.

"Testing Injection Wells with Rate and Pressure Data" by Ramakrishnan et al. SPE Formation Evaluation, Sep. 1994, pp. 228–236.

"A Laboratory Investigation of Permeability in Hemispherical Flow With Application to Formation Testers" by Ramakrishnan et al; SPE Formation Evaluation, Jun. 1995, pp. 99–108.

*Primary Examiner*—Donald E. McElheny, Jr.
*Attorney, Agent, or Firm*—David P. Gordon; Keith G. W. Smith; William B. Batzer

[57] ABSTRACT

Methods and apparatus for estimating values for formation parameters such as permeability, relative permeability, and skin factors for a plurality of locations in the formation are provided. Fluid is forced into a capped borehole at a measured rate, and a borehole logging tool is run in the borehole to measure indications of pressure and conductivity. Estimates of the parameters and the measured fluid flow rate(s) into the formation are used in conjunction with a jointly inverted pressure transient model and saturation-conductivity model in order to compute indications of expected pressure and indications of expected conductivity-related profiles as a function of depth and time. The expected pressures and expected conductivity related profile indications are then compared to the pressures and conductivity indications measured by the borehole logging tool, and an iterated comparison between the computed values and the measured values is used to provide determinations of the formation parameters. According to a preferred embodiment, the pressure transient model is for compressible flow and provides an estimated calculated fluid flow into the layers of the formation; the estimated calculated fluid flow being an input to the saturation-conductivity model which is for incompressible flow.

25 Claims, 3 Drawing Sheets

METHOD AND APPARATUS FOR CHARACTERIZING EARTH FORMATION PROPERTIES THROUGH JOINT PRESSURE-RESISTIVITY INVERSION

BACKGROUND

1. Field of the Invention

This invention relates broadly to apparatus and methods for investigating subsurface earth formations. More particularly, the present invention relates to borehole tools and methods which use a combination of fluid injection techniques and resistivity measurements for quantifying formation characteristics such as permeability, relative permeability, and skin factors. For purposes herein, the term "borehole" when utilized by itself or in conjunction with the word "tool" is to be understood in its broadest sense to apply to cased and uncased boreholes and wells.

2. State of the Art

The determinations of permeability and other hydraulic properties of formations surrounding boreholes such as relative permeability and skin factors are very useful in gauging the producibility of formations, and in obtaining an overall understanding of the structure of the formations. For the reservoir engineer, permeability and relative permeability are generally considered fundamental reservoir properties, the determinations of which are at least equal in importance with the determination of porosity, fluid saturations, and formation pressure. Indeed, determinations of relative permeabilities to oil and water are crucial for forecasting oil recovery during water flooding or natural water drives. The economic viability of a reservoir therefore depends upon the nature of these saturation dependent permeabilities.

Before production, when obtainable, cores of the formation provide important data concerning permeability. However, cores are difficult and expensive to obtain, and core analysis is time consuming and provides information about very small sample volumes. In addition, cores, when brought to the surface may not adequately represent downhole conditions. Thus, in situ determinations of permeability over the length of the borehole are highly desirable.

Suggestions regarding in situ determination of permeability via the injection or withdrawal of fluid into or from the formation and the measurement of pressures resulting therefrom date back at least to U.S. Pat. No. 2,747,401 to Doll (1956). The primary technique presently used for in situ determination of permeability is the "drawdown" method where a probe of a formation testing tool is placed against the borehole wall, and the pressure inside the tool (e.g., at a chamber) is brought below the pressure of the formation, thereby inducing fluids to flow into the formation testing tool. By measuring pressures and/or fluid flow rates at and/or away from the probe, and processing those measurements, determinations regarding permeability are obtained. These determinations, however, have typically been subject to large errors. Among the reasons for error include the fact that liberation of gas during drawdown provides anomalous pressure and fluid flow rate readings, and the fact that the properties of the fluid being drawn into the borehole tool are not known accurately. Another source of error is the damage to the formation (i.e., pores can be clogged by migrating fines) which occurs when the fluid flow rate towards the probe is caused to be too large. See, e.g., Ramakrishnan et al., SPE 22689 (1991).

More recent patent disclosures of permeability testing tools include U.S. Pat. No. 4,742,459 to Lasseter, and U.S. Pat. No. 4,860,581 to Zimmerman et al. (both of which are assigned to the assignee hereof) which further develop the draw-down techniques. The Zimmerman et al. patent mentions that in the drawdown method, it is essential to limit the pressure reduction so as to prevent gas liberation. In order to prevent gas liberation, Zimmerman et al. propose a flow controller which regulates the rate of fluid flow into the tool.

Additional progress in in situ permeability measurement is represented by U.S. Pat. Nos. 5,269,190 and 5,247,830, (both of which are assigned to the assignee hereof, and incorporated by reference in their entireties herein). In U.S. Pat. No. 5,269,190, borehole tools, procedures, and interpretation methods are disclosed which rely on the injection of both water and oil into the formation whereby endpoint effective permeability determinations can be made. In U.S. Pat. No. 5,247,830, methods are disclosed for making horizontal and vertical-permeability measurements without the necessity for measuring flow rate into or out of the borehole tool. These inventions advance the art significantly. However, even with the improvements in permeability measurement techniques, the accuracy and scope of the information obtained is not to the level desired. In particular, in the formation fluid sampling tools, only a limited number of samples may be obtained which can be analyzed. Thus, the locations from which the samples are taken must be well chosen. Further, even if sampling of formation fluids is not desired, but measurements are taken via drawdown and/or injection and measuring, it will be appreciated that each procedure is time-consuming. Thus, it is desirable to gain large amounts of information from each procedure, and again location of the tool in the borehole is critical as is the quantity and quality of the data accumulated. For example, it might be desirable to take the vertical permeability in a portion of a formation which crosses a bed boundary or a fracture, or alternatively to avoid such a situation. To cross a bed boundary or fracture, accurate location of the tool is required such that one probe or sensor lies on one side of the bed boundary or fracture while the other probe or sensor lies on the other side of the bed boundary. Similar accuracy is required to avoid straddling a boundary or fracture if such is desired.

While bed boundary locations are determinable and thin beds are locatable via the use of other well established tools such as the FMS (Formation Micro Scanner—another mark of the assignee hereof, details of which are found in Ekstrom, M. P. et al., "Formation Imaging With Microelectrical Scanning Arrays"; The Log Analyst; Vol. 28, No. 3, May–June 1987), and other tools (both impedance and current injection tools), it will be appreciated that this information obtained from a previous investigation of the borehole must be correlated with the depth of the permeability tool being run in the borehole at the time for a proper setting of the permeability tool. The tool depth is typically determined by monitoring the cable from which the tool is hung. However, because of the stretching and twisting of the cable, among other things, the exact location and orientation of the tool vis-a-vis the formation is never as exact as desired.

Some of these problems are overcome by the integrated permeability measurement and resistivity imaging tool set forth in co-owned U.S. Pat. No. 5,335,542, which is hereby incorporated by reference herein in its entirety. In U.S. Pat. No. 5,335,542, a tool having probes with electrodes and means for fluid withdrawal and/or injection are provided for making an investigation of the formation. As fluid is withdrawn or injected into the formation, the fluid pressure of the formation is obtained, and electromagnetic data is obtained by the electrodes. The electromagnetic and fluid pressure data are then processed using various formation and tool models to obtain relative permeability information, endpoint permeability, wettability, etc.

While the tool and method of co-owned U.S. Pat. No. 5,335,542 is believed to be effective in providing important relative permeability and other information, it will be appreciated that in order to gather information from which the desired determinations are made, the borehole tool must be in contact with the formation. Thus, the data gathering process is time consuming and data is limited to specific locations, although information regarding other locations can be generated from the data obtained at the specific locations. In addition, while some depth of investigation is obtained, the interpretation does not extend to a reservoir length scale.

As mentioned above, the skin (also called "skin factor" or "skin damage") of a well is another important variable in the production of a well. During the drilling of a well, the mudcake can invade the formation and alter the sandface, and hence the permeability of the formation adjacent the borehole. In addition, during production, fines in the produced fluid can move into the pores of the formation adjacent the borehole, thereby reducing the effective permeability of the formation. While it is known to shut down production and conduct a test which maps the pressure in the wellbore over time in order to assess skin-damage to the wellbore, it will be appreciated that the known test only provide a single value for the entire wellbore, while only portions of the wellbore may be damaged. Thus, if wellbore cleaning is attempted using acid, the acid may travel into the clean non-damaged areas of the formation, while skin damage correction is not productively accomplished.

SUMMARY OF THE INVENTION

It is therefore an object of the invention to provide methods and apparatus for measuring saturation dependent relative permeabilities of a formation.

It is another object of the invention to provide a model for interpreting pressure, flow rate, and resistivity data for the purposes of generating permeability, relative permeability, and skin factor determinations along the length of the borehole, on a reservoir length scale.

It is a further object of the invention to provide a borehole tool for obtaining measurements of pressure, flow rates, and resistivity data which can be utilized for the interpretation model.

It is an additional object of the invention-to provide methods and apparatus for measuring permeabilities, relative permeabilities, and skin factors of a formation without requiring the use of a tool which is in direct contact with the formation.

In accord with the objects of the invention which will be discussed in more detail hereinafter, the method of the invention broadly comprises estimating values for a plurality of formation parameters such as permeability, relative permeability, and skin factors for a plurality of locations in the formation, using those estimations in conjunction with a pressure transient model and a saturation-conductivity model and in conjunction with a measured fluid flow into the formation as a function of time in order to compute expected pressure and conductivity-related profiles as a function of depth and time, measuring pressures and electrical indications of the formation as a function of depth and time, and conducting an iterated comparison between the computed values and the measured values to provide determinations of the formation parameters. More particularly, an iterative process is followed where estimates for permeability ($k_i$), relative permeability parameters (e.g., residual water saturation, maximum residual oil saturation, connate water saturation, pore size distribution index—see U.S. Pat. No. 5,497,321), and skin factor ($S_i$), and measured fluid flow (Q(t)) are input into a pressure transient model for compressible flow which provides computed estimated pressures ($P_i(t)$) at each layer i, and estimated calculated fluid flow ($Q_i(t)$) into each layer as outputs. The calculated fluid flow into each layer and the relative permeability estimates are then input into a saturation-conductivity model for incompressible flow (it being appreciated that the compression of the fluid having little impact for this purpose) in order to generate conductivity profiles $\sigma_i(r,t)$ of the formation. The conductivity profiles are then translated into an expected tool response (voltages or currents) using a model of the borehole tool. The expected tool response is then compared to the actual tool response (i.e., the conductivity-related measurements) and the computed pressures output by the pressure transient model are compared to the actually measured pressures using a least squares comparison to provide feedback error. In addition, if available, actually measured flow rates can be compared to the estimated calculated fluid flow in determining feedback error. The feedback error is used to adjust the estimated values for permeability, skin factor, and relative permeability, and the entire process is iterated using the adjusted estimated values until the errors between the measured values and computed values meet desired criteria; at which time the obtained values are used as determinations of the formation parameters of interest.

In an alternative embodiment of the processing aspect of the invention which is particularly applicable where the layers of the formation have fluid communication therebetween, i.e., a communicating system (as opposed to the assumed system where the layers produce independent of each other), the determinations of permeability, skin factor, and of the relative permeability parameters are made on a depth increment basis rather than a layer by layer basis. Thus, the index i used to reference layers in the preferred embodiment are used to index depth (i.e., distance into the borehole) in the alternative embodiment.

According to a preferred aspect of the method invention, the conductivity model utilized in generating conductivity profiles which are input into the tool response model is the same model set forth in co-owned U.S. Pat. No. 5,497,321 which is hereby incorporated by reference herein in its entirety. Also, according to a preferred aspect of the invention, the pressure transient model is either taken from a simulator such as "ECLIPSE" (sold by GeoQuest of Houston, Tex.) or is a straight-forward extension of the model set forth in Ramakrishnan, T.S. and Kuchuk, F. J. "Testing Injection Wells With Rate and Pressure Data", SPE 20536, Society of Petroleum Engineers pp. 228–236 (Sept. 1994).

In further accord with the objects of the invention, the apparatus of the invention generally comprises-a-borehole tool having a plurality of electrodes and at least one pressure sensor, a flow measurement device which may be part of the borehole tool or located at the top of the borehole, and a computer or processor for processing the data obtained by the borehole tool according to the method set forth above. The electrodes of the tool may be arranged and may be of the type which are found in any number of commercial tools of Schlumberger Technology Services, including the magnetic dipole Array Induction Imaging Tool, the magnetic dipole ARC5 (Array Compensated Resistivity Tool), the electric dipole DLT (Dual Laterolog), the dual dipole HALS (High Resolution Azimuthal Laterolog Sonde), and the monopole ULSEL.

Alternatively, an in accord with a preferred embodiment of the invention, an array of equispaced voltage measurement electrodes can be used in conjunction with monopole/dipole current emitting electrodes, where focusing is achieved by measuring absolute voltages and voltage first derivatives and second derivatives. The pressure sensor may likewise take different forms such as a compensated quartz gauge (CQG) or a.strain gauge. The flow rate measurement device may be a spinner or a Venturi type device.

According to a preferred aspect of the borehole tool apparatus invention, the tool is run up and down the borehole while fluid is being forced into the capped borehole (and formation). Because the borehole tool obtains pressure data and voltage or current data without bringing the tool into contact with the formation, and because the method of the invention processes the pressure data and voltage or current data to provide determinations of permeability, relative permeability, and skin factors, it will be appreciated that valuable information regarding the formation is obtained and determined in a much simpler manner than accomplished previously in the art.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
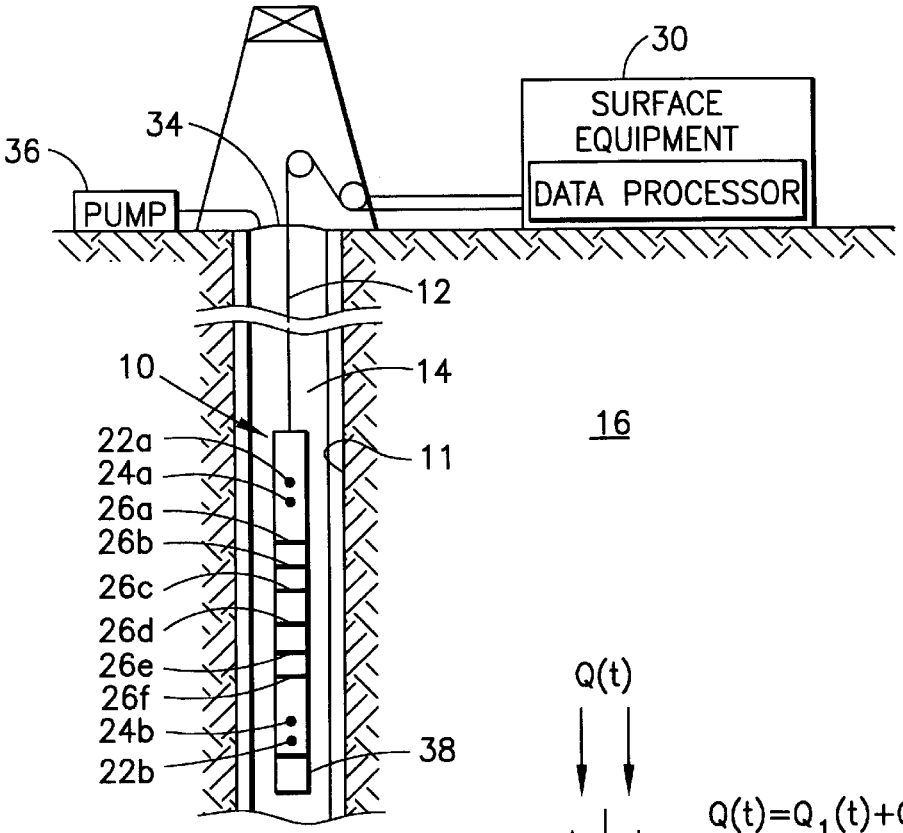
FIG. 1 is a schematic diagram of the logging tool and system of the invention seen in conjunction with a capped borehole.

A logging tool 10 which is suspended from a conventional wireline cable 12 is seen in FIG. 1. The logging tool 10 is located in a borehole 14 which traverses a formation 16. According to the preferred embodiment of the invention, the logging tool includes a pressure sensor (transducer) 20 and a plurality of preferably equispaced electrodes, preferably including two monopole current emitting electrodes 22*a*, 22*b*, two dipole current emitting electrodes 24*a*, 24*b*, and a plurality of voltage measurement electrodes 26*a*–26*f*. Each of the measurement electrodes 26*a*–26*f* is preferably a ring electrode extending completely around the tool 10, and each measurement electrode can also operate as a current emitting electrode if desired. Typically, as is well known in the resistivity arts, and in accord with the present invention, current is generated and emitted by the emitting electrodes, and the resulting voltage signals which are detected by the measurement electrodes are recorded and processed. The processing may occur downhole by use of a processor (not shown) and/or uphole in processing equipment 30; the information being transmitted uphole via the wireline cable 12. Typically, if processed downhole, a microprocessor is used. When processing uphole, a higher powered processor such as a VAX produced by Digital Equipment Corporation of Brainard, Massachusetts is used. Regardless, details of the processing the resistivity information obtained by the preferred tool of the invention are discussed below with reference to FIG. 4.

As seen in FIG. 1, and in accord with the invention, in order to obtain the desired information for processing, the borehole 14 is capped by a cap 34, and fluid (e.g., saline) is forced into the borehole through the cap by pumps 36. A flow gauge 38 for measuring a flow rate Q, is provided either on the tool (as shown) or in the flow path from the pumps into the borehole. The flow gauge 38 may be of a Venturi, spinner, or other type, with the spinner type being shown on the bottom of the tool string of the borehole tool in FIG. 1. As fluid is forced into the borehole and out into the formation, and as the injection front advances through the formation, the logging tool 10 is moved up and down (one or more passes) in the borehole while logging resistivity, pressure, and if applicable, flow rate information.

Figure 2:
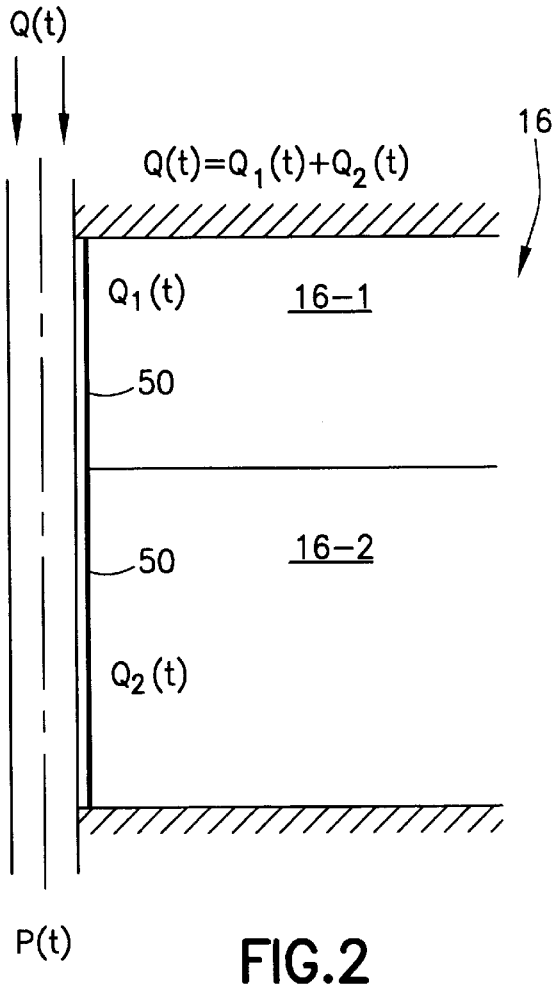
FIG. 2 is a schematic diagram of a portion of the borehole and formation with indications of fluid flow therein.

Turning to FIG. 2, and for purposes of explanation, a schematic is seen of two layers 16-1, 16-2 of the formation 16 traversed by the borehole 14. The formation is seen to have a skin region 50 at the borehole which can limit the productivity of hydrocarbons from the formation. Fluid flowing at a flow rate Q(t) is indicated to enter the layers formation through the skin region at rates of $Q_1(t)$ and $Q_2(t)$. Assuming that layers 16-1 and 16-2 are the only layers in the formation into which fluid enters, the fluid flow can be defined by $Q(t)=Q_1(t)+Q_2(t)$. Of course, if additional layers are present in the formation, pressurized fluid will flow into those layers as well, and the above equation can be expanded to account for the additional layers. Also shown in FIG. 2 is a pressure measurement P(t) which is made by the pressure sensor. Resistivity measurements are not shown in FIG. 2, but are discussed hereinafter with reference to FIGS. 4 and 5.

Figure 3:
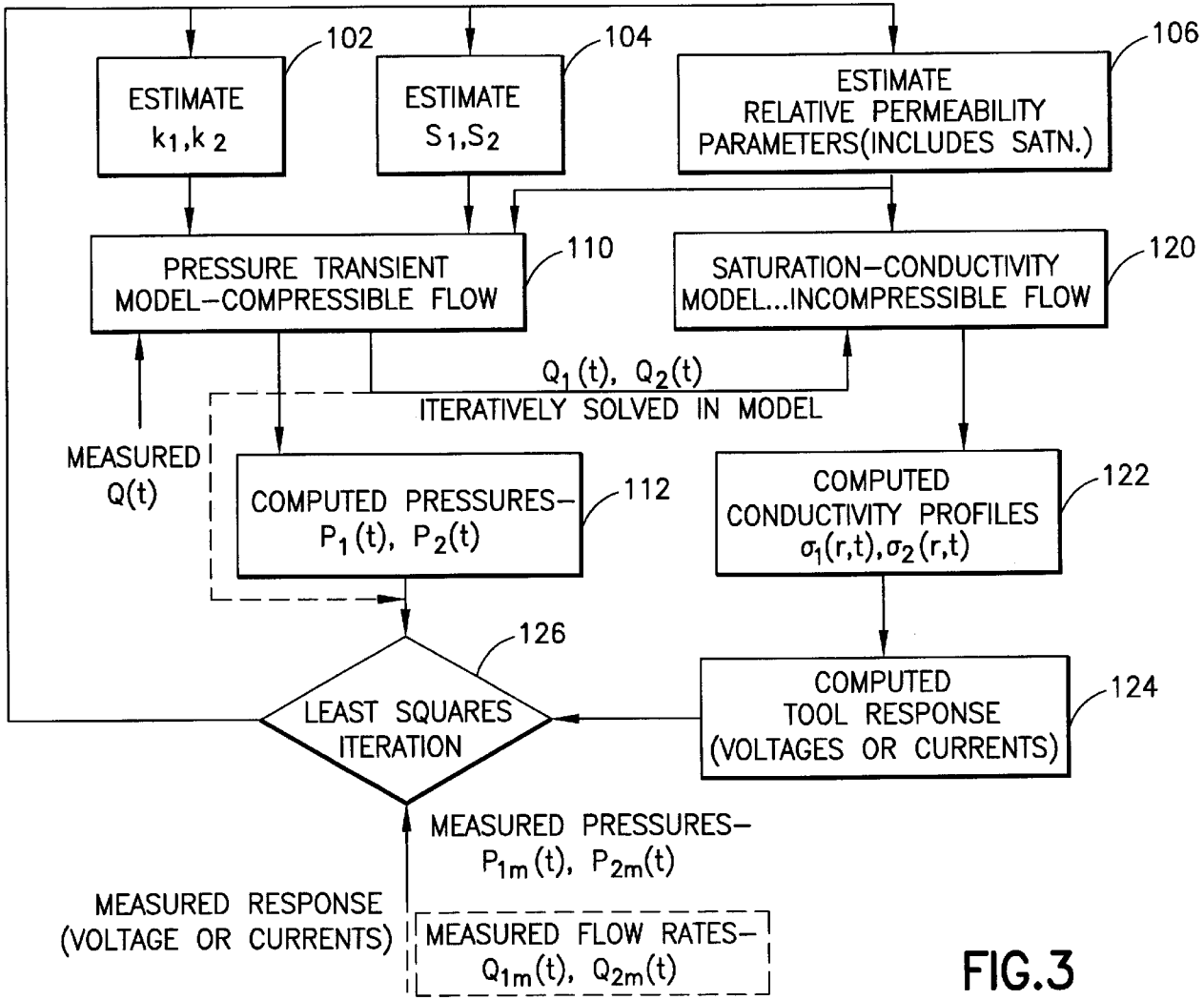
FIG. 3 is a high level flow diagram of the processor of the invention.

According to a primary aspect of the invention, the pressure measurements, resistivity measurements, and fluid flow measurements gathered by the borehole tool are processed by a processor according to an iterative process seen in FIG. 3. In particular, according to the invention, at 102, 104 and 106, estimates for permeability ($k_i$), relative permeability parameters, and skin factor ($S_i$) are provided for each layer of the formation. These estimates may be obtained from interpretation of logs, or from educated guesses based on the known geology of the formation. A first pass estimate of permeability may be obtained, for example, from commercial services of the assignee hereof Schlumberger such as the CMR or MDT (both of which are trademarks of Schlumberger). Similarly, relative permeability parameters may be deduced utilizing the teachings of previously incorporated U.S. Pat. No. 5,497,321. Regardless of how obtained, the estimates are provided in conjunction with the measured flow rate Q(t) into a pressure transient model for compressible flow 110 which provides as an output at 112 computed predicted pressures ($P_i(t)$) at each layer i, and as an output at 114 predicted fluid flow rates ($Q_i(t)$) into each layer. According to the preferred embodiment of the invention, the pressure transient model is either taken from a simulator such as "ECLIPSE" (available from GeoQuest) or is a straight-forward extension of the model set forth in Ramakrishnan, T. S. and Kuchuk, F. J. "Testing Injection Wells With Rate and Pressure Data", SPE 20536, Society of Petroleum Engineers pp. 228–236 (September 1994). In particular, the flow rate of SPE 20536 may be replaced by a layer flow rate as set forth in Appendix A hereto. At 120, the calculated expected fluid flow rates ($Q_i(t)$) and the relative permeability parameter estimates are provided as inputs to a saturation-conductivity model for incompressible flow in order to generate at 122 conductivity profiles $\sigma_i(r,t)$ of the formation, where r is the radial distance into the formation from the borehole. Preferably, the conductivity model utilized in generating conductivity profiles which are input into the tool response model is the same model set forth in co-owned U.S. Pat. No. 5,497,321 which is hereby incorporated by reference herein in its entirety. The conductivity profiles are then translated at 124 into an expected tool response (voltages or currents) using a model of the borehole tool which is being utilized to measure resistivity. Commercially available models include MAFIA available from Collaboration, of Darmstadt, Germany, and MAXWELL available from Ansoft Corp., Pittsburgh, Pa. At 126, the expected tool response and the estimated pressures computed at 112 are then compared to the actual tool response (i.e., the conductivity-related measurements) and to the actually measured pressures ($P_{im}(t)$), utilizing a least squares comparison to provide a feedback error. If available, measured layer flow rates $Q_{mi}(t)$ can also be compared to predicted flow rates $Q_i(t)$ utilizing the least squares comparison in determining feedback error. If desired, the least squares comparison can be weighted to stress either the pressure comparison or the conductivity related measurement comparison, or the flow rate comparison. Regardless, the feedback error obtained from the least squares comparison is used to adjust the originally estimated values for permeability, skin factor, and relative permeability parameters, and the entire process is iterated using the adjusted estimated values until the errors between the measured values and computed values meet desired criteria; at which time the obtained values are used as determinations of the formation parameters of interest.

In an alternative embodiment of the invention which is particularly applicable where the layers of the formation have fluid communication therebetween, i.e., a communicating system (as opposed to the assumed system where the layers produce independent of each other), the determinations of permeability, skin factor, and relative permeability parameters are made on a depth increment basis rather than a layer by layer basis. Thus, the index i which is used in the preferred embodiment to reference layers, is used to reference depth in the alternative embodiment.

Figure 4:
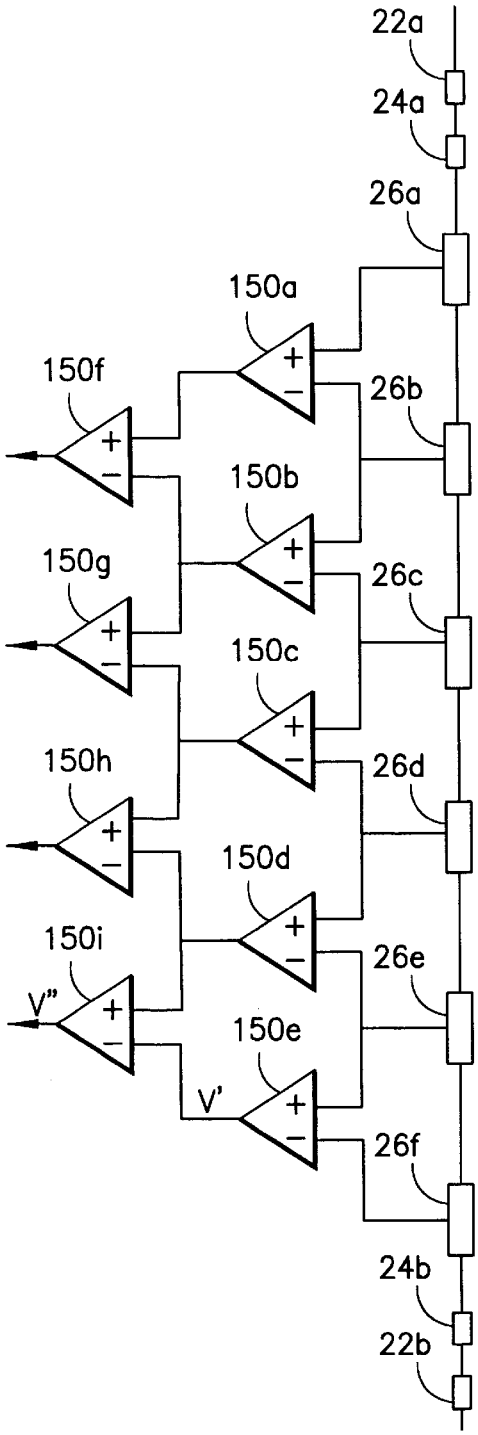
FIG. 4 is a high level circuit diagram of the preferred resistivity portion of the logging tool of FIG. 1.

In accord with the preferred embodiment of the invention, a schematic of the resistivity portion of the borehole tool is seen in FIG. 4. As described with reference to FIG. 1, the resistivity portion of the borehole tool includes two monopole current emitting electrodes 22*a*, 22*b*, two dipole current emitting electrodes 24*a*, 24*b*, and a plurality of equispaced voltage measurement electrodes 26*a*–26*f*. It will be appreciated that many more voltage measurement electrodes 26 could be utilized. In addition, as seen in FIG. 4, the resistivity portion of the borehole tool also includes a plurality of differential amplifiers 150*a*, 150*b*, 150*c*, 150*d*, 150*e*, 150*f*, 150*g*, 150*h*, 150*i*. Differential amplifier 150*a* measures the difference in the voltages (dV) measured by measurement electrodes 26*a* and 26*b*. That voltage difference is the same as the first derivative (dV) of the voltage at that location in the borehole, and is proportional to the current (I(z)) flowing between the electrodes in the borehole at depth z. Similarly, differential amplifier 150*b* measures the difference in voltage measured by measurement electrodes 26*b* and 26*c*, while differential amplifiers 150*c*, 150*d* and 150*e* measure the differences in voltage measured by measurement electrodes 26*c* and 26*d*, 26*d* and 26*e*, and 26*e* and 26*f* respectively. The second derivatives of the voltages (V") are measured by differential amplifiers 150*f*–150*i*; i.e., differential amplifier 150*f* measures the difference between the output of differential amplifiers 150*a* and 150*b*, while amplifiers 150*g*, 150*h*, and 150*i* measure the difference between the outputs of differential amplifiers 150*b* and 150*c*, 150*c* and 150*d*, and 150*d* and 150*e* respectively. The second derivative of the voltage V" is proportional to the first derivative of the current (I') and represents the difference in currents located at different points in the borehole; i.e., the difference in axial currents. In other words, the second derivatives of the voltage measured at the outputs of differential amplifiers 150*f*–150*i* are indicative of the amount of current entering the formation from the borehole along any length dz of the borehole; i.e., the radial current.

Figure 5:
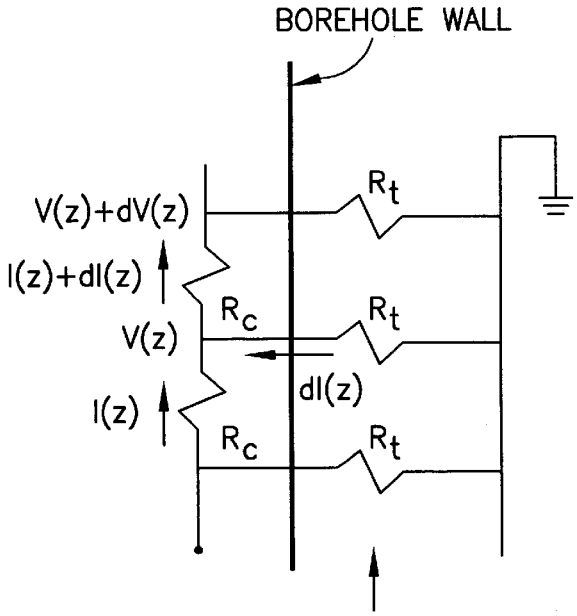
FIG. 5 is a circuit diagram representing the resistivity of the formation as measured by the tool of FIG. 4

The relationships between the currents, voltages and resistances in the borehole and in the formation are seen in FIG. 5. The borehole, which may generally be considered a homogeneous medium has a resistance $R_c$ per unit length dz, while the formation will have a resistivity of $R_t$ and a conductance $G=1/R_t$ per unit length, which may vary depending on the formation layer. If the voltage measured at any electrode is V(z), the voltage measured at another electrode will be V(z)+dV(z), provided a current I(z) is flowing. Likewise, as suggested above, if a first current I(z) is flowing at one location in the borehole, and a second current I(z) +dI(z) is flowing at another location in the borehole, the difference of the two (dI(z)) is flowing into the formation between those locations. Thus, several equations may be derived. First, Ohm's law in the borehole suggests that:

$$dV(z)=-(R_c dz)I(z) \tag{1}$$

Stated another way, $$dV/dz=-R_c I \tag{2}$$

Similarly, Ohm's law in the formation suggests:

$$dI(z)=-(G dz)\ V(z) \tag{3}$$

Stated another way, $$V=-R_t(dI/dz) \tag{4}$$

From equations (2) and (4), $$R_c I=R_t(d^2I/dz^2) \tag{5}$$

Solving equation (5) yields:

$$I(z)=I(0)e^{-z/L_c} \tag{6}$$

where $L_c$ is the characteristic length of the current decaying in the borehole, such that $$L_c = \sqrt{(R_t / R_c)} \tag{7}$$

Using equations (1) through (7), the resistivity of any layer of an inhomogeneous formation can be expressed as:

$$R_t=-K(V/I') \tag{8}$$

(with the derivative and second derivatives rotated by ' and ") or as $$R_t=KR_c(V/V")=-K(V/I)(V'/V") \tag{9}$$

Likewise, the resistivity of any layer in a homogeneous formation can be expressed according to any of:

$$R_t=KR_c(V'/V'')^2=-K(V'/I)(V'/V'')^2 \quad (10)$$

$$R_t=KR_c(V/V')^2=-K(V/I)(V/V') \quad (11)$$

$$R_t=KR_c(I/I'')=-K(V'/I'') \quad (12)$$

$$R_t=KR_c(I'/I'')^2=-K(V'/I)(I'/I'')^2 \quad (13)$$

$$R_t=KR_c(I/I')^2=-K(V'/I')(I/I') \quad (14)$$

Typically, for purposes of the invention, it is preferred that equations (8) or (9) be utilized to provide a resistivity measurement for a specific electrode pair. Such a resistivity is predominantly sensitive to the formation resistivity at a radial distance determined by the source-receiver spacing. As discussed above with reference to FIG. 4, the electrodes are used to measure the voltage V, while the various differential amplifiers are used to measure the first derivatives V' of the voltage (which are the currents I), and the second derivatives V" of the voltage (which are the first derivatives I' of the current). It will be appreciated that the plurality of electrode pair will provide measurements that permit radial resistivity profiling of the formation. This is done by using a forward electrical model to translate the model generated radial resistivity profiles into values that correspond to the measurements of equations (8) or (9).

In accord with a preferred method of the invention, the resistivity is logged prior to capping the wellbore and injecting fluid into the wellbore. After the wellbore is capped, and fluid is injected (flow rate Q or $Q_i$ being measured), several passes are made by the tool in the borehole in order to generate several resistivity logs of the formation as the pressured fluid dissipates into the formation. In addition, pressure measurements are concurrently made. The resistivity logs and pressure measurements can be made during fluid injection as well as after fluid injection.

There have been described and illustrated herein apparatus and methods for using a combination of fluid injection techniques and resistivity measurements for the quantification of formation characteristics such as permeability, relative permeability, and skin factors. While particular embodiments of the invention have been described, it is not intended that the invention be limited thereto, as it is intended that the invention be as broad in scope as the art will allow and that the specification be read likewise. Thus, while particular pressure transient and saturation-conductivity models have been disclosed as being preferred, it will be appreciated that other models can be utilized; provided, of course, that the pressure transient model provides the desired outputs of computed pressures and of fluid flow characteristics (the latter being in a form which can be used by the saturation-conductivity model), and the saturation conductivity model provides the desired conductivity profile outputs. In addition, while particular processing utilizing a least squares algorithm iteration was described, those skilled in the art will appreciate that other error minimization techniques can be utilized. Further, while a particular preferred borehole tool was described as having equispaced voltage measurement electrodes and both monopole and dipole current electrode sources, it will be appreciated different arrangements could be utilized. For example, only the monopole or only the dipole current electrode sources might be used. Alternatively, the electrodes of the tool may be arranged and may be of the type which are found in any number of commercial tools of Schlumberger Technology Services, including the magnetic dipole AIT (Array Induction Imaging Tool), the magnetic dipole ARC5 (Array Compensated Resistivity Tool), the electric dipole DLT (Dual Laterolog), the dual dipole HALS (High Resolution Azimuthal Laterolog Sonde), and the monopole ULSEL. The electrodes may also be segmented as in the commercially available azimuthal resistivity imager (ARI) tool of Schlumberger in order to provide azimuthal information. Also, while the borehole tool of the invention is described as having a pressure sensor, it will be appreciated by those skilled in the art that in addition to the pressure sensor or sensors being located on the tool, an independent pressure sensor placed in contact with the formation (behind a casing, or on the borehole wall) which is located at a location which is unlikely to be influenced by the skin parameters can be utilized. Such a formation sensor will provide pressure information relating to pressure found deep inside the formation; which information can be utilized in the pressure transient model. It will therefore be appreciated by those skilled in the art that yet other modifications could be made to the provided invention without deviating from its spirit and scope as so claimed.

APPENDIX A

Multilayer Injection Testing

Consider a comingled system of m layers, into which an injection well is placed. A single pressure p(t) represents wellbore pressure, whereas the layer flow rates are $q_i(t)$. In the quasistatic approximation, Laplace transform is applicable. The individual layer response functions are denoted $g_i(t,\zeta_i)$, where $\zeta_i(t)=\int_0^t q_i(t)dt$. $\zeta_i$ is a slowly varying function of time, and therefore one may write $$p(s)=q_i(s)g_i(s;\zeta_i(t)). \quad (1)$$

Since the sum of all layer flow rates should add up to q(t), we have the result that $$q(s) = p(s)\sum \frac{1}{g_i(s_i\zeta_i(t))}. \quad (2)$$

Using Eq. 1 in Eq. 2, we get m equations of the form $$\frac{q_i(s)}{q(s)} = \frac{\frac{1}{g_i(s_i\zeta_i(t))}}{\sum \frac{1}{g_i(s_i\zeta_i(t))}} \quad (3)$$

Eq. 3 suggests an iterative procedure for solving for $q_i(t)$. Make an assumption regarding $q_i(t)$, according to single phase permeabilities of the layers, calculate $g_i$, compute $q_i$ and iterate until convergence.

The response functions $g_i$ are the dimensional version of the term in square brackets used in T. S. Ramakrishnan and F. Kuchuk 1994 Testing Injection Wells with Rate and Pressure Data. SPE Form. Eval. 9, 228–236. (which is journal version of SPE20536).

We claim:

1. A method for determining values for at least one parameter of a formation traversed by a borehole at a plurality of locations along the borehole, said at least one parameter including at least one of permeability, factors of relative permeability, and skin factors, including:

a) estimating values for a plurality of formation parameters for said plurality of formation locations;

b) using the estimated values for said plurality of formation locations as inputs to a formation pressure transient model, and as inputs to a formation saturation-conductivity model, said formation pressure transient model providing computed pressures as outputs and said formation saturation-conductivity model providing computed conductivity profiles as outputs, and a first of said formation pressure transient model and said formation saturation-conductivity model providing an additional output which is used as an additional input to a second of said formation pressure transient model and said formation saturation-conductivity model;

c) injecting fluid into the borehole;

d) using a borehole tool, measuring indications of pressures and measuring indications of conductivities of different locations in said formation as fluid moves from the borehole into the formation;

e) iteratively comparing said indications of measured pressures and indications of measured conductivities with indications of said computed pressures and indications of said computed conductivity profiles and providing feedback values to change said estimated values in order to provide a determination of said at least one parameter at said at least plurality of locations.

2. A method according to claim 1, wherein:

said injecting fluid includes measuring a flow rate at which said fluid is injected into the borehole, said flow rate being provided as another input into said formation pressure transient model.

3. A method according to claim 2, wherein:

said additional output is provided by said formation pressure transient model for input into said formation saturation-conductivity model and comprises a set of estimated fluid flow rates into said plurality of locations of said formation.

4. A method according to claim 3, wherein:

said measuring a flow rate comprises measuring flow rates into said plurality of locations of said formation, and said iteratively comparing further comprises comparing said measured flow rates into said plurality of locations of said formation with said estimated fluid flow rates into said plurality of location of said formation.

5. A method according to claim 3, further comprising:

f) providing a tool response model for the borehole tool, wherein said computed conductivity profiles are provided as inputs to the tool response model which provides as outputs said indications of computed conductivity profiles.

6. A method according to claim 5, wherein:

said indications of computed conductivity profiles are computed voltages, and said measured indications of conductivity are measured voltages.

7. A method according to claim 5, wherein:

said computed conductivity profiles are as a function of time and radial depth into said formation from said borehole.

8. A method according to claim 1, further comprising:

f) providing a tool response model for the borehole tool, wherein said computed conductivity profiles are provided as inputs to the tool response model which provides as outputs said indications of computed conductivity profiles.

9. A method according to claim 8, wherein:

said indications of computed conductivity profiles are computed voltages, and said measured indications of conductivity are measured voltages.

10. A method according to claim 1, wherein:

said iteratively comparing comprises a least squares iteration.

11. A method according to claim 1, wherein:

said at least one parameter comprises permeability, factors of relative permeability, and skin factors, said estimating values comprises estimating values for permeability, factors of relative permeability, and skin factors, for a plurality of locations in the formation, said inputs to said formation pressure transient model include said permeability, said factors of relative permeability, and said skin factors, and said inputs to said formation saturation-conductivity model includes said factors of relative permeability.

12. A method according to claim 11, wherein:

said formation pressure transient model assumes that fluid in the borehole is compressible, and said formation saturation-conductivity model assumes that fluid in the borehole is incompressible.

13. A method according to claim 1, wherein:

said plurality of formation locations are chosen based on locations of layers in the formation.

14. A method according to claim 1, wherein:

said plurality of formation locations are chosen as a function of depth into the borehole.

15. A method according to claim 3, wherein:

said at least one parameter comprises permeability, factors of relative permeability, and skin factors, said estimating values comprises estimating values for permeability, factors of relative permeability, and skin factors, for a plurality of locations in the formation, said inputs to said formation pressure transient model include said permeability, said factors of relative permeability, and said skin factors, and said inputs to said formation saturation-conductivity model includes said factors of relative permeability.

16. A method according to claim 1, wherein:

said step of using a borehole tool comprises measuring indications of pressures and measuring indications of conductivities of different locations in said formation while moving said borehole tool in the borehole.

17. A system for determining values for at least one parameter of a formation traversed by a borehole at a plurality of locations along the borehole, said at least one parameter including at least one of permeability, factors of relative permeability, and skin factors, said system comprising:

a) means for injecting fluid under pressure into the borehole;

b) means for measuring a flow rate at which said fluid is injected into the borehole;

c) a borehole tool means for traversing the borehole, including a plurality of electrode means for generating electrical signals and for measuring resulting electrical signals while said injected fluid is moving into the formation, and pressure measurement means for measuring pressures in the borehole while said injected fluid is moving into the formation; and d) processing means coupled to the borehole tool said processing means for (i) receiving indications of said measured resulting electrical signals and indications of said measured pressures, (ii) storing estimated values for a plurality of formation parameters for said plurality of formation locations, (iii) storing a formation pressure transient model and a formation saturation-conductivity model, and (iv) processing said indications of said measured resulting electrical signals and said indications of said measured pressures by using said estimated values for said plurality of formation locations and said measured flow rate as inputs to a formation pressure transient model and as inputs to a formation saturation-conductivity model, said formation pressure transient model providing computed pressures as outputs and said formation saturation-conductivity model providing computed conductivity profiles as outputs, and a first of said formation pressure transient model and said formation saturation-conductivity model providing an additional output which is used as an additional input to a second of said formation pressure transient model and said formation saturation-conductivity model, and by iteratively comparing said indications of measured pressures and indications of measured electrical signals with indications of said computed pressures and indications of said computed conductivity profiles and providing feedback values to change said estimated values in order to provide a determination of said at least one parameter at said plurality of locations.

18. A system according to claim 17, wherein:

said plurality of electrode means includes a current injection means for injecting currents into the borehole and formation, wherein said currents comprise said electrical signals, and voltage measurement means for measuring voltages wherein said voltages comprise said measured electrical signals.

19. A system according to claim 18, wherein:

said voltage measurement means comprises a plurality of voltage measurement electrodes, and said system further comprises a plurality of first differential amplifier means coupled to said plurality of voltage measurement electrodes for measuring the difference in voltage measured by pairs of said plurality of voltage measurement electrodes, and a plurality of second differential amplifier means coupled to said plurality of first differential amplifier means for measuring differences in outputs from pairs of said plurality of first different amplifier means.

20. A system according to claim 18, wherein:

said current injection means comprises a dipole current electrode and a monopole current electrode.

21. A system according to claim 17, wherein:

said means for measuring a flow rate is a spinner which is provided on said borehole tool.

22. A system according to claim 17, wherein:

said additional output comprises a set of estimated fluid flow rates, and said processing means uses said set of estimated fluid flow rates as inputs into said formation saturation-conductivity model.

23. A system according to claim 22, wherein:

said means for measuring a flow rate comprises means for measuring flow rates into said plurality of locations of said formation, and said processing means iteratively compares said measured flow rates into said plurality of locations of said formation with said set of estimated fluid flow rates.

24. A system according to claim 22, wherein:

said processing means for storing a tool response model for said borehole tool, wherein said computed conductivity profiles are provides as inputs to said tool response model which provides as outputs said indications of computed conductivity profiles.

25. A system according to claim 17, wherein:

said at least one parameter comprises permeability, factors of relative permeability, and skin factors, said estimated values comprise estimated values for permeability, factors of relative permeability, and skin factors, for a plurality of locations in the formation, said inputs to said formation pressure transient model include said permeability, said factors of relative permeability, and said skin factors, and said inputs to said formation saturation-conductivity model includes said factors of relative permeability.

* * * * *